US007172462B1

(12) United States Patent
Gronowicz, Jr.

(10) Patent No.: US 7,172,462 B1
(45) Date of Patent: Feb. 6, 2007

(54) FUSE

(75) Inventor: William Gronowicz, Jr., Westland, MI (US)

(73) Assignee: Yazaki North America, Inc., Canton, MI (US)

( * ) Notice: Subject to any disclaimer, the term of this patent is extended or adjusted under 35 U.S.C. 154(b) by 0 days.

(21) Appl. No.: 11/203,802

(22) Filed: Aug. 15, 2005

(51) Int. Cl.
*H01R 13/68* (2006.01)

(52) U.S. Cl. ..... 439/620.26; 439/755

(58) Field of Classification Search ..... 439/620.26, 439/755; 337/180, 181, 186–189
See application file for complete search history.

(56) References Cited

U.S. PATENT DOCUMENTS 950,932 A 1/1910 Lehmann ..... 337/186
5,453,648 A * 9/1995 Bradfield ..... 310/71
5,805,047 A 9/1998 De Villeroche et al. .... 337/290
5,854,583 A 12/1998 Falchetti ..... 337/290
6,607,860 B2 8/2003 Hulbert et al. ..... 429/178
6,696,914 B2 * 2/2004 Haupt et al. ..... 337/295
6,902,434 B2 * 6/2005 Stack ..... 439/620.28
6,932,650 B1 * 8/2005 Freitag ..... 439/620.26

FOREIGN PATENT DOCUMENTS

US 2004/0018417 1/2004 ..... 429/61

* cited by examiner

*Primary Examiner*—Neil Abrams
(74) *Attorney, Agent, or Firm*—Young & Basile, P.C.

(57) ABSTRACT

An over-current fuse of unitary, disposable construction is used to protect battery and alternator cables from over-current conditions. The fuse comprises a cylindrical body of high-temperature plastic having an axial through-bore and recessed annular seat surfaces formed into the opposite surfaces. Metal rings are mounted on the annular seat surfaces and are electrically interconnected by a fuse element.

7 Claims, 4 Drawing Sheets

FUSE

FIELD OF THE INVENTION

This invention relates to fuses and more particularly to a disposable, unitary fuse for providing inexpensive over-current protection in various automotive applications such as battery and alternator connections.

BACKGROUND OF THE INVENTION

It is highly desirable to provide over-current protection in certain automotive circuits including battery and alternator cables. It is known to provide battery cables with pyrotechnic devices which respond to over-current conditions to destroy a section of battery cable thereby to effect a disconnection. The actuation of such a device requires replacement of the entire battery cable to restore the vehicle to normal operating condition; this is an expensive repair.

SUMMARY OF THE INVENTION

The present invention provides inexpensive over-current protection for battery cables, alternator cables, and the like without the use of pyrotechnic devices which destroy sections of expensive connecting cables. In general, the fuse of the present invention is a unitized, easily replaced, disposable element comprising a high-temperature, non-conductive spacer body carrying two annular conductive rings which are inter-connected along the outside surface of the spacer body by a fuse element. Such a fuse is easily assembled into a battery cable or alternator cable connection and easily replaced in the event that an over-current condition destroys the fuse element to create an open circuit condition.

In the preferred form, the spacer body is made of a high-temperature plastic, is cylindrical and includes an axial through-bore between two opposite parallel annular seats having radially inboard and outboard collars to receive the conductive rings in essentially flush association therewith. The rings are sized to overlie and contact annular battery and cable terminals when assembled therebetween. The rings and spacer body can be unitized in any of several ways including the use of a plastic over-wrap with a window to permit inspection of the fuse element.

DETAILED DESCRIPTION OF THE ILLUSTRATIVE EMBODIMENT

Figure 1:
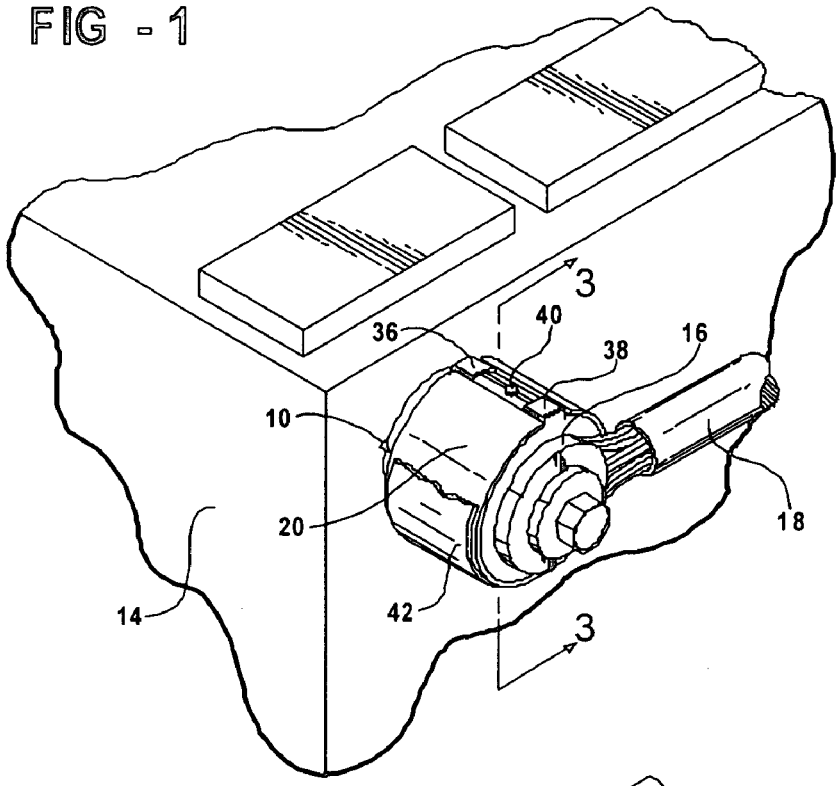
FIG. 1 is a perspective view of a battery cable connection showing a first embodiment of the fuse installed therein.
Figure 2:
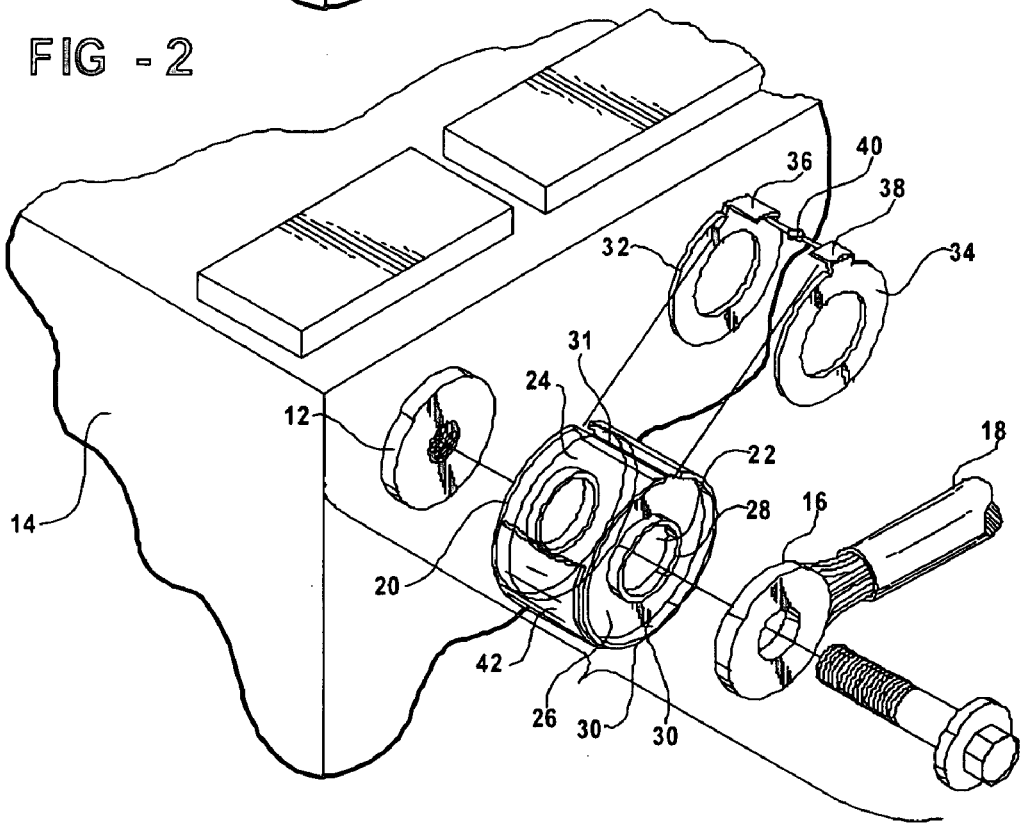
FIG. 2 is an exploded view of the connection of FIG. 1.
Figure 3:
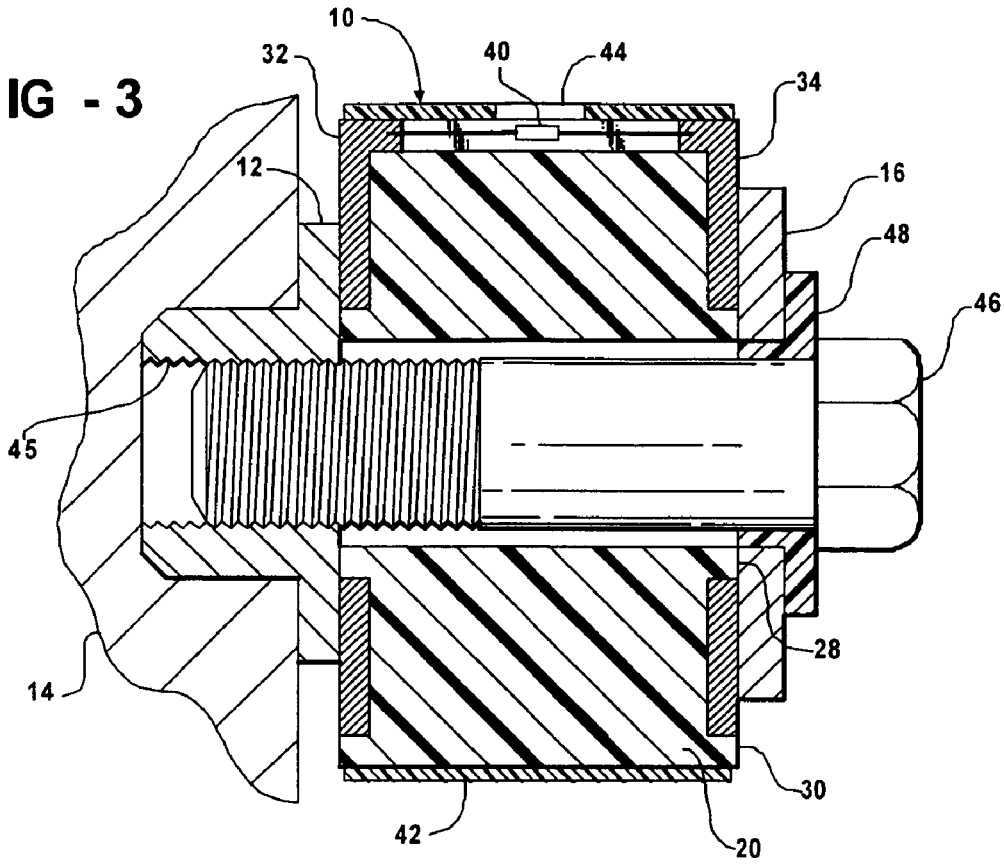
FIG. 3 is a sectional view through the fuse connection of FIG. 1.

Referring first to FIGS. 1 through 3, there is shown a unitized, high-current fuse 10 between the flat annular side-mounted terminal 12 of a battery 14 and the flat annular terminal 16 of a mating battery cable 18. The fuse 10 comprises a spacer body 20 of high temperature plastic having an axial through-bore 22 between opposite parallel end surfaces in which recessed seats 24 and 26 are formed. The seats 24 and 26 are annular and define radially inboard and outboard collars 28 and 30. An axial slot 31 extends between the two seats 24 and 26 along the outside peripheral surface of the spacer body 20 and thereby interrupts the outer collar 30 as best shown in FIGS. 1 and 2.

Stamped annular metal rings 32 and 34 with bent over tabs 36 and 38 respectively are mounted on the annular seats 24 and 26 respectively so as to be essentially flush with the top surfaces of the collars 28 and 30. The tabs 36 and 38 fit within the slot 31 and are electrically interconnected by way of a temperature-sensitive fuse element 40. A band 42 of high temperature plastic having a transparent window 44 overlying the fuse element 40 unitizes the assembly of the spacer body 20 and the rings 32 and 34 to facilitate storage and installation of new undepleted fuses as well as the disposal of depleted fuses in which the fuse element 40 has been destroyed or "blown". The outer protective band 42 may be considered optional in which case other methods of unitizing the assembly are preferably employed. For example, the rings 32 and 34 may be adhesively bonded to the seats 24 and 26 or the dimensions of the collars 28 and 30 and rings 32, 34 may be chosen to require a press fit of the rings into the seats. Combinations of these and other techniques may also be used.

In the assembled state, a bolt 46 and a non-conductive washer 48 are added to the combination. The fuse 10 is placed against the battery terminal 12 with the through-hole 22 in alignment with the threaded hole 45 in the battery terminal and the ring 32 contactingly overlying the outer face of the terminal 12. The bolt 46 with the washer 48 assembled thereto is disposed through the bore 22 and into the threaded hole 45 with the annular terminal 16 and the battery cable 18 underlying the washer and overlying the ring 34. This arrangement produces a conductive circuit from the battery terminal 12 to the ring 32, through the fuse element 40 to the ring 34 and from the ring 34 to the battery cable terminal 16. In the event of an over-current condition, the fuse element 40 melts or disintegrates to create an open circuit condition. Replacement of the fuse 10 is easily effected by removing the threaded bolt 46 and washer 48, throwing the depleted fuse 10 away and replacing it with an identical fuse with an intact fuse element 40. Inspection of the condition of the fuse element 40 is facilitated by way of the transparent plastic window 44 in the band 42.

Figure 4:
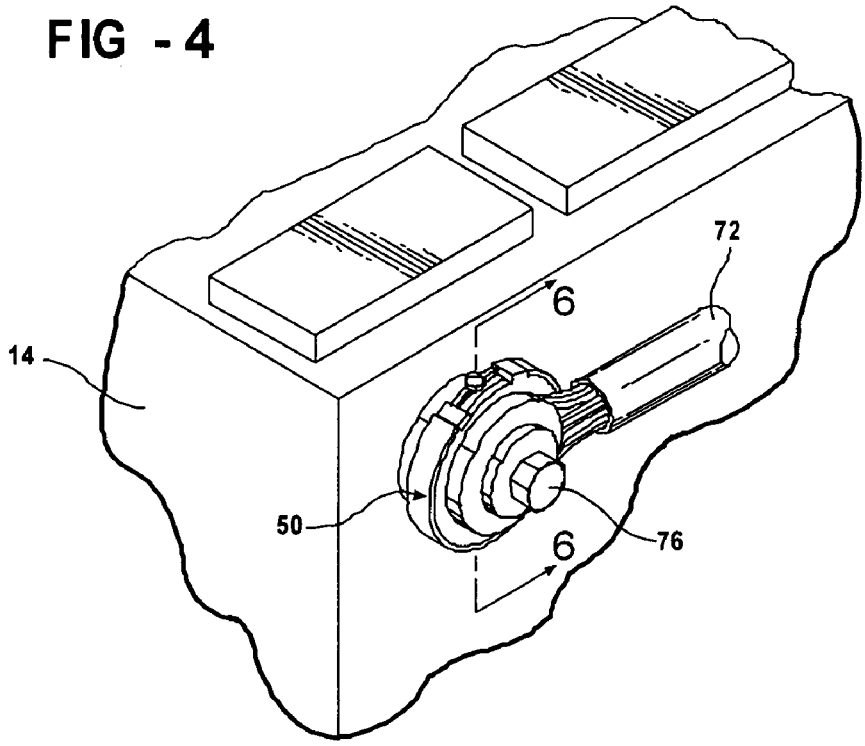
FIG. 4 is a perspective view of a second, thinner embodiment of the fuse of the present invention as used in a battery cable connection.
Figure 5:
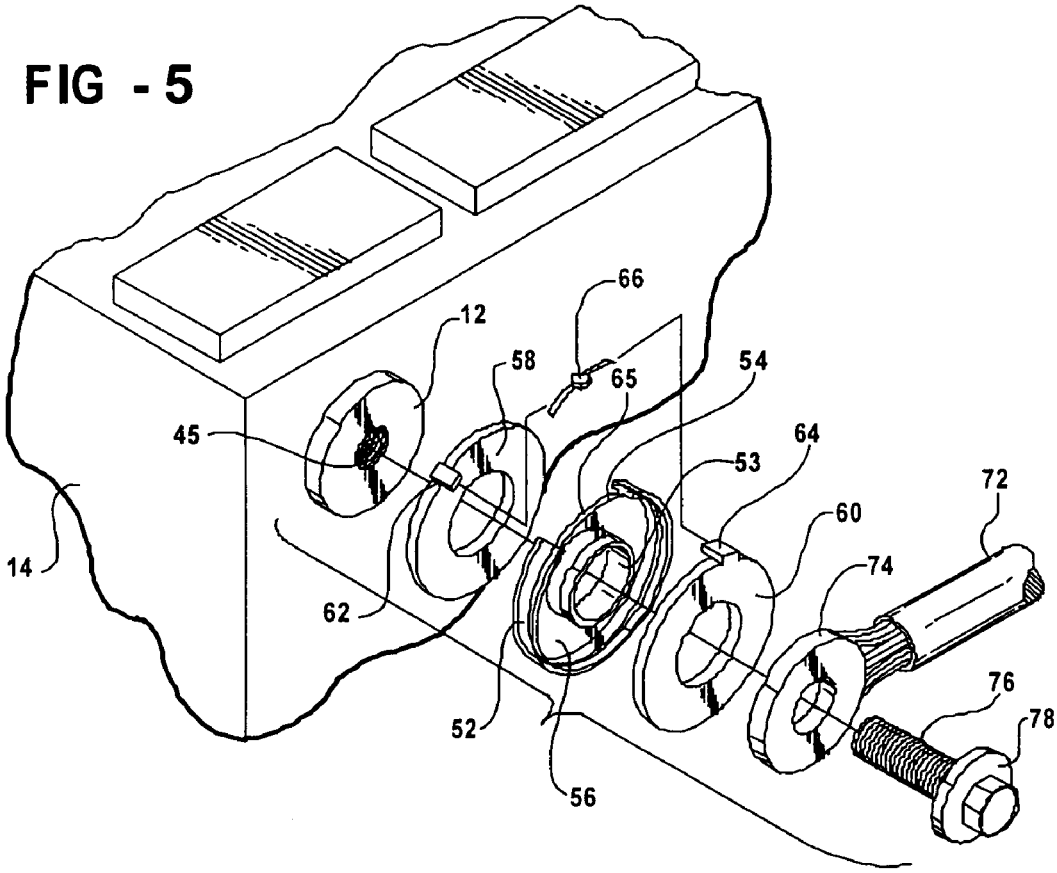
FIG. 5 is an exploded view of the embodiment of FIG. 4.
Figure 6:
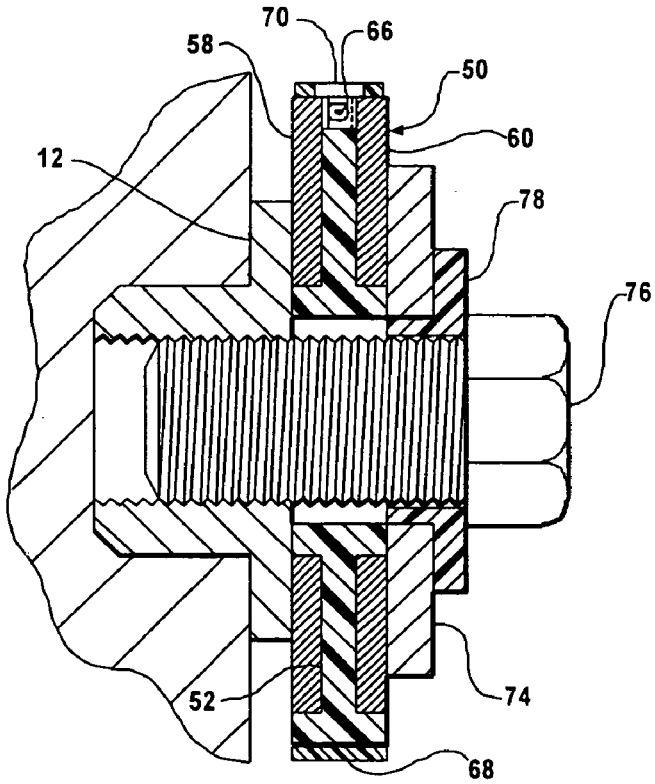
FIG. 6 is a sectional view of the embodiment of FIG. 4.

Referring now to FIGS. 4–6, a slightly modified embodiment of the invention is shown in the form of a fuse 50 in combination with the battery 14 having a side-mounted annular terminal 12. The fuse 50, like the fuse 10, comprises a spacer body 52 of high temperature plastic having an axial through-bore 53 slightly larger than the diameter of the threaded bore 45 in the terminal 12. Recessed annular seats, 54 and 56 are formed in the opposite parallel surfaces of the spacer body 52 to receive stamped conductive metal rings 58 and 60 which form part of the unitized fuse 50. The rings 58 and 60 have bent over edge tabs 62 and 64 which extend into a slot 65 in circumferentially spaced relationship. A high temperature-sensitive fuse element 66 is electrically connected between the tabs 62 and 64. A plastic band 68 with a transparent window 70 is placed over the outer edge of the cylindrical body 52 to integrate or unitize the fuse 50. Again, the rings 58 and 60 may be bonded to the seats using non-conductive adhesive and/or press fit into the space between the raised collars which border the seats 54 and 56.

The assembly of FIGS. 4–6 is completed by a bolt 76 which is threaded into the hole 45 in the terminal 12 and carries a plastic or otherwise non-conductive washer 78 which bears against the underlying terminal 74 of the battery cable 72.

The assembled state is shown in FIGS. 4 and 6 wherein the fuse 50 is sandwiched between the outer annular face of the terminal 12 and the inner annular face of the battery cable terminal 74. A circuit is completed through the rings 58 and 60 and the fuse element 66 as long as the fuse element 66 is intact. Replacement of the fuse is a simple matter of removing the bolt 76 and washer 78, throwing the depleted fuse 50 away and replacing it with a new fuse. The rings 58 and 60 are cheap stampings of copper or plated aluminum and are disposed of along with the inexpensive plastic spacer body and the depleted fuse.

Figure 7:
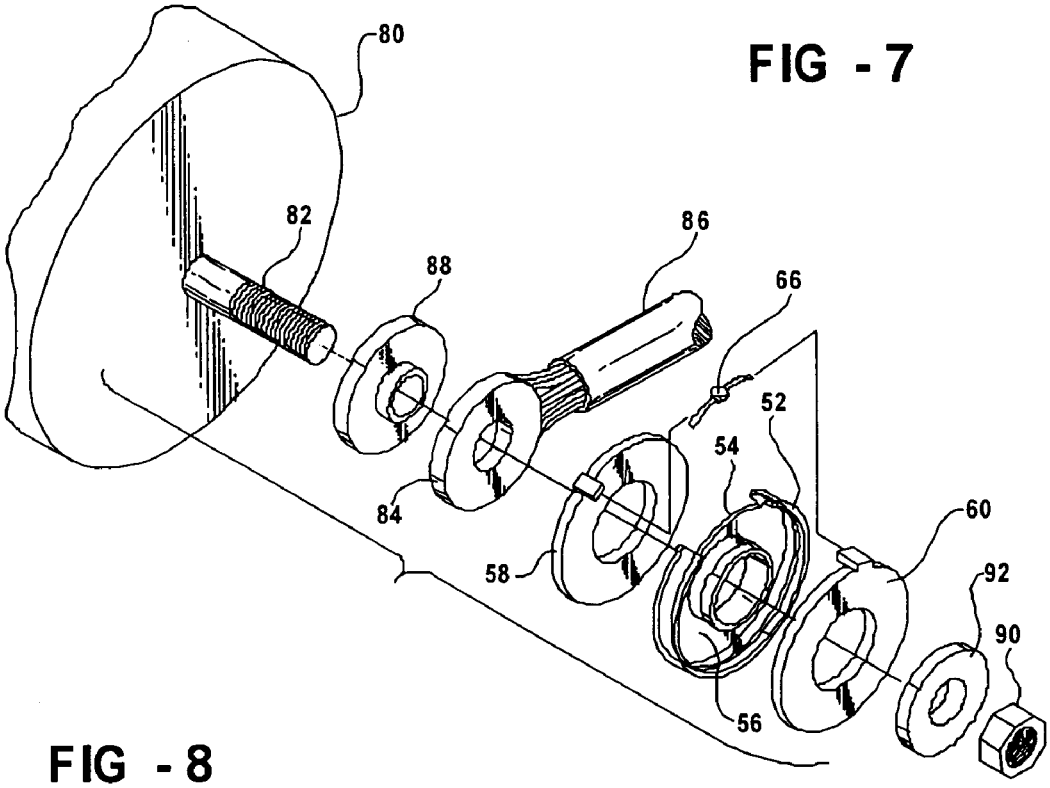
FIG. 7 is an exploded view of the use of the embodiment of FIG. 4 in an alternator/cable connection.
Figure 8:
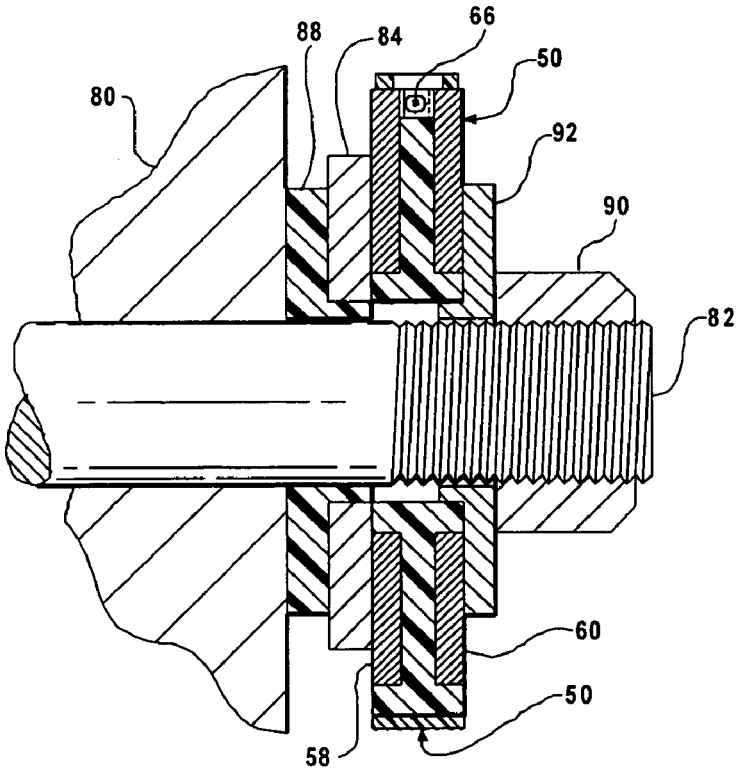
FIG. 8 is a sectional view of the assembly of FIG. 7.

Looking now to FIGS. 7 and 8, the fuse 50 of FIGS. 4–6 is used to provide over-current protection for the connection between the load carrying threaded stud 82 of an alternator 80 and the flat annular conductive terminal 84 of the alternator output cable 86. The assembly further comprises a plastic washer 88 which fits between the face of the alternator 80 and the alternator cable terminal 84. The assembly further comprises a nut 90 which can be threaded onto the stud 82 and a conductive washer 92 which overlies and abuts the outside surface of the fuse ring 60.

In the assembled state shown in FIG. 8, the output circuit for an intact fuse comprises the stud 82, the nut 90, the conductive washer 92 and the outer ring 60. From the outer ring 60 current flows through the fuse element 66 to the inner ring 58 which overlyingly abuts and transfers current to the cable terminal 84. When the fuse element 66 is depleted by the high temperature conditions associated with an over-current condition, the aforementioned circuit is broken and, even though the alternator 80 might continue to produce an output, it does not flow to or through the cable 86. Replacement of the fuse 50 and restoration of the alternator output circuit to an operative condition is easily effected by removing the nut 90 and the washer 92 from the stud 82 and sliding a new fuse 50 into place. Although not shown in FIG. 7 or 8, the fuse 50 may also include the plastic band 68 with window 70 as shown in FIG. 6.

While the invention has been described with reference to specific embodiments and specific applications, it will be appreciated that various modifications and additions to these embodiments will occur to persons skilled in the art and, therefore, the foregoing description is to be construed and taken in an illustrative rather than limiting sense.

The invention claimed is:

1. A fuse comprising the unitary combination of:

a non-conductive body having a cylindrical outer surface, opposite parallel end surfaces and an axial through-hole extending between said end surfaces, said body further including a slot formed in the cylindrical outer surface and extending between said end surfaces;

first and second conductive rings mounted on said end surfaces;

a fuse element disposed in said slot and electrically connected between said rings; and a sleeve extending around said body, the sleeve including a transparent cover portion disposed over said fuse element.

2. A fuse as defined in claim 1 wherein said end surfaces define annular seats having annular collars outboard of said seats such that said rings, when in said seats, are substantially flush with said collars.

3. A fuse as defined in claim 1 further including bent-over tabs formed on the outer edges of said annular rings for making electrical connections with said fuse element.

4. A fuse for a battery and cable combination wherein said battery and cable have matching flat annular terminals, said fuse comprising the unitary combination of:

a cylindrical non-conductive body having an outside cylindrical surface, opposite parallel seat surfaces and an axial through-hole extending between said seat surfaces to receive a threaded stud secured into but extending from said battery terminal;

first and second conductive metal rings mounted on said seat surfaces, each ring having a tab extending along the outside cylindrical surface;

a fuse element mounted on the outside cylindrical surface of said body and electrically connected between said tabs; and said rings being sized so as to abutingly overlie said battery and cable terminals when assembled thereto.

5. A fuse as defined in claim 4 wherein the seat surfaces are annular recesses bordered by raised collars.

6. A fused connector between an alternator of the type having a threaded stud forming an output terminal and a cable of the type having a flat annular conductive terminal comprising the unitary combination of:

a cylindrical non-conductive body having an outer surface, opposite parallel seat surfaces and an axial through-hole extending between said seat surfaces, the seat surfaces being recessed annular surfaces bordered radially inboard and outboard by raised collars;

first and second flat conductive metal rings mounted on said seat surfaces between the inboard and outboard raised collars; and a fuse element mounted on the outer surface of said body and electrically connected between said rings, said through-hole being adapted to receive said stud and at least one of said rings being sized to overly said cable terminal when said fuse is assembled between said alternator stud and said cable terminal.

7. The fused connector defined in claim 6, wherein the seat surfaces are recessed annular surfaces bordered radially by raised collars.

* * * * *